US006274298B1

(12) United States Patent
Nair et al.

(10) Patent No.: US 6,274,298 B1
(45) Date of Patent: Aug. 14, 2001

(54) PROTECTIVE OVERCOAT COMPRISING POLYESTER IONOMERS FOR PHOTOGRAPHIC ELEMENTS

(75) Inventors: Mridula Nair, Penfield; Tamara K. Jones, Rochester; Joseph S. Sedita, Albion; David M. Teegarden, Pittsford; Bobbi A. Wohlschlegel, Hemlock, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/588,960

(22) Filed: Jun. 7, 2000

(51) Int. Cl.[7] ..... G03C 1/76; G03C 5/26; G03C 11/06

(52) U.S. Cl. ..... 430/350; 430/432; 430/434; 430/533; 430/539; 430/961

(58) Field of Search ..... 430/533, 539, 430/961, 350, 432, 434

(56) References Cited

U.S. PATENT DOCUMENTS

| | | | | |
|---|---|---|---|---|
| 2,173,480 | | 9/1939 | Jung . | |
| 2,259,009 | | 10/1941 | Talbot . | |
| 2,331,746 | | 10/1943 | Talbot . | |
| 2,706,686 | | 4/1955 | Hilborn . | |
| 2,798,004 | | 7/1957 | Weigel . | |
| 3,113,867 | | 12/1963 | Van Norman et al. . | |
| 3,190,197 | | 6/1965 | Pinder . | |
| 3,397,980 | | 8/1968 | Stone . | |
| 3,415,670 | | 12/1968 | McDonald . | |
| 3,443,946 | | 5/1969 | Grabbäfer et al. . | |
| 3,502,501 | | 3/1970 | Burczyk et al. . | |
| 3,697,277 | | 10/1972 | King . | |
| 3,733,293 | | 5/1973 | Gallagher et al. . | |
| 4,092,173 | | 5/1978 | Novak et al. . | |
| 4,171,979 | | 10/1979 | Novak et al. . | |
| 4,298,682 | * | 11/1981 | Bishop | 430/533 |
| 4,307,174 | * | 12/1981 | Noonan et al. | 430/533 |
| 4,333,998 | | 6/1982 | Leszyk | 430/12 |
| 4,426,431 | | 1/1984 | Harasta et al. | 430/14 |
| 4,999,266 | | 3/1991 | Platzer et al. | 430/14 |
| 5,179,147 | | 1/1993 | Jones | 524/201 |
| 5,376,434 | | 12/1994 | Ogawa et al. | 428/195 |
| 5,447,832 | | 9/1995 | Wang et al. | 430/523 |
| 5,853,926 | | 12/1998 | Bohan et al. | 430/14 |
| 5,856,051 | | 1/1999 | Yau et al. | 430/537 |
| 5,866,282 | * | 2/1999 | Bourdelais et al. | 430/536 |
| 5,958,658 | * | 9/1999 | Smith et al. | 430/961 |
| 6,077,648 | * | 6/2000 | Nair et al. | 430/531 |
| 6,110,659 | * | 8/2000 | Hatakeyama et al. | 430/533 |

* cited by examiner

*Primary Examiner*—Richard L. Schilling
(74) *Attorney, Agent, or Firm*—Chris P. Konkol

(57) ABSTRACT

The present invention is directed to a photographic element comprising a support, at least one silver halide emulsion layer superposed on the support, and a processing-solution-permeable protective overcoat overlying the silver halide emulsion layer. The processing solution permeable overcoat is composed of a polyester ionomer. The present invention is also directed to a method of making a photographic print involving developing the photographic element. The imaged photographic element exhibits water, stain, and wet-abrasion resistance.

17 Claims, No Drawings

PROTECTIVE OVERCOAT COMPRISING POLYESTER IONOMERS FOR PHOTOGRAPHIC ELEMENTS

FIELD OF THE INVENTION

The present invention relates to photographic elements having a protective overcoat that resists fingerprints, common stains, spills and wet abrasion. More particularly, the present invention provides a processing-solution-permeable overcoat comprising a polyester ionomer, which becomes resistant to spills, stain and wet abrasion after the image is developed.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin or similar natural or synthetic hydrophilic polymers have proven to be the binders of choice for silver halide photographic elements. Unfortunately, when gelatin or similar polymers are formulated so as to facilitate contact between the silver halide crystals and aqueous processing solutions, the resultant coatings are not as fingerprint and stain resistant as would be desirable, particularly in view of the handling or environment that an imaged photographic element may commonly experience at various times and circumstances. Thus, fingerprints can permanently mark the imaged element. The imaged element can be easily stained by common household products, such as foods or beverages, for example, coffee spills.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described in U.S. Pat. Nos. 4,092,173, 4,171,979, 4,333,998 and 4,426,431. A drawback for both the solvent coating method and for the radiation cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

Various lamination techniques are known and practiced in the trade. U.S. Pat. Nos. 3,397,980, 3,697,277 and 4,999,266 describe methods of laminating a polymeric sheet film, as a protective layer, on a processed image. U.S. Pat. No. 5,447,832 describes the use of a protective layer containing a mixture of high and low Tg latices as a water-resistant layer to preserve the antistat property of a $V_2O_5$ layer through photographic processing. This protective layer is not applicable to the image formation layers, however, since it will detrimentally inhibit the photographic processing. U.S. Pat. No. 3,443,946 provides a roughened (matte) scratch-protective layer, but not one designed to be water-impermeable or resistant. U.S. Pat. No. 3,502,501 is intended to provide protection against mechanical damage only; the layer in question contains a majority of hydrophilic polymeric materials, and must be permeable to water in order to maintain processability. U.S. Pat. No. 5,179,147 likewise provides an overcoat that is not water-protective.

Protective coatings that need to be applied to the image after it is formed, several of which were mentioned above, adds a significant cost to the final imaged product. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Since the particles are incorporated entirely within the uppermost layer, this approach does not suffer from a lack of mechanical strength and integrity during transport and handling prior to image formation and fusing. However, the scratch resistance of such an overcoat after fusing is a serious concern, since polyethylene is a relatively soft material.

Similarly, commonly assigned U.S. Ser. No. 09/353,939 (Docket 79581) and U.S. Ser. No. 09/548,514 (Docket 80493), respectively, describe the use of a polystyrene-based material and a polyurethane-based material, with gelatin as the binder, in an overcoat for a photographic element, which overcoat can be fused into a water resistant overcoat after photographic processing is accomplished to generate an image. Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Ser. No. 09/448,213 (Docket 80220) disclose the use of a second polymer such as a gelatin or polyvinyl alcohol to improve processability and reduce coating defects.

Still further improvements in the properties of protective overcoats are desired. A problem with photographic elements that have post-process water-resistance resulting from an overcoat provided at the point of manufacture, which overcoat exhibits permeability to aqueous solutions during processing, is that the wet-abrasion resistance of some of these overcoats is not completely satisfactory. For example, while an overcoat may provide fairly good wet-abrasion resistance, it may not provide very good image development characteristics. Thus, it would be desirable to obtain overcoats that provide improved stain and wet-abrasion resistance, in addition to water-resistance and pre-development permeability.

SUMMARY OF THE INVENTION

The present invention is directed to a processing-solution-permeable overcoat for a photographic element that provides water, stain and wet-abrasion resistance in the final product while maintaining very good image-developability. For example, such a photographic element may comprise a support, at least one silver-halide emulsion layer superposed on the support, and overlying the silver-halide emulsion layer, a processing-solution-permeable protective overcoat. The processing-solution-permeable overcoat is composed of a polyester containing ionic (or ionizable) functionalities. The polyester is an essentially hydrophobic high molecular weight, substantially amorphous, thermoplastic homopolymer or copolymer, in which the ionic groups, for example sulfonic acid groups, provide water-dispersibility prior to coating. The polyester may comprise a blend with at least one other water dispersible polymer. The other polymer may comprise a variety of materials, including condensation and/or addition polymer such as vinyl polymers, polyurethanes, urethane-vinyl hybrids such as IPNs, polyethylenes, and the like or mixtures thereof.

In the preferred embodiment of the present invention, the overcoat in the imaging element, before development, further comprises a water-soluble or solubilizable hydrophilic polymer. For example, the coating may optionally comprise poly(vinyl alcohol), cellulose ethers, n-vinyl amides, poly (ethyl oxazoline), poly(ethylene oxide), starch, dextrans, proteins, whey, albumin, poly(acrylic acid), alginates, gums, or combinations thereof.

The present invention is also directed to a method of making a photographic element such as a print that is water resistant, stain resistant and wet-abrasion resistant without the application of a protective overcoat material after development or during photoprocessing. In particular, the photographic element is developed in an alkaline developer solution having a pH greater than 7. This allows the developer to penetrate the protective coating. After the pH is reduced, for example in a bleach fix solution, the protective overcoat then becomes relatively water-resistant. Although the processing-solution-permeable overcoat does not require fusing, optional fusing may improve the water-resistance further.

Thus, the present invention can provide, in the imaged photographic element, a protective overcoat that is water-resistant and shows little or no scuffing in the wet or dry state and which shows excellent developability during photographic processing.

DESCRIPTION OF THE PREFERRED EMBODIMENTS

The present invention provides a simple and inexpensive way to improve the water, stain and abrasion resistance of processed photographic elements. In accordance with the invention, the protective overcoat is applied over the photographic element prior to exposure and processing. In particular, in order to improve resistance to stains, spills, or fingerprinting, while maintaining processability, a special overcoat formulation is applied to the emulsion side of photographic products, particularly photographic prints, which may encounter frequent handling and abuse by end users. The photographic element comprises a support having thereon at least one light-sensitive layer and coated over the light-sensitive layer furthest from the support a continuous layer of a polyester having ionic (or ionizable) functionalities, referred to as a polyester ionomer. The term "polyester ionomer" of the overcoat, as used herein, includes branched and unbranched, homo and copolymers, crosslinked or uncrosslinked polymers.

As indicated above, the polyester ionomer is an essentially hydrophobic, substantially amorphous, thermoplastic polymer in which ionic groups or moieties are present in sufficient number to provide water dispersibility prior to coating. The polyester dispersions provide advantageous properties such as good film-formation, good chemical-resistance, wet-abrasion resistance, excellent fingerprint resistance, toughness, elasticity and durability. Furthermore, the polyesters exhibit tensile and flexural strength and resistance to various oils.

Procedures for the preparation of polyester ionomers are described in U.S. Pat. Nos. 3,018,272; 3,563,942; 3,734,874; 3,779,993; 3,929,489; 4,307,174, 4,395,475, 5,939,355 and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150° to about 300° C. and a pressure very near vacuum, although higher pressures can be used.

The substantially amorphous polyesters described herein (referred to as "ionomers" or "polyester ionomers") contain at least one ionic moiety, which can also be referred to as an ionic group, functionality, or radical. In a preferred embodiment of this invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties can be anionic or cationic in nature, but preferably, they are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

One type of ionic acid component has the structure

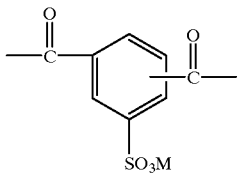

where M=H, Na, K or $NH_4$.

Ionic dicarboxylic acid recurring units can be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (published Apr. 14, 1977). Other suitable polyester ionomers for protective overcoats in the imaged elements of the present invention are disclosed in U.S. Pat. Nos. 4,903,039 and 4,903,040, which are incorporated herein by reference.

Another type of ionic dicarboxylic acid found useful in the practice of this invention are those having units represented by the formula:

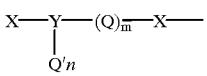

wherein each of m and n is 0 or 1 and the sum of m and n is 1; each X is carbonyl;

Q has the formula:

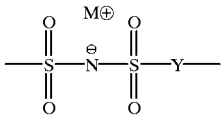

Q' has the formula:

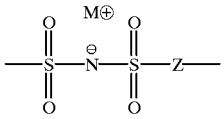

Y is a divalent aromatic radical, such as arylene (e.g. phenylene, naphthalene, xylylene, etc.) or arylidyne (e.g. phenenyl, naphthylidyne, etc.); Z is a monovalent aromatic radical, such as aryl, aralkyl or alkaryl (e.g. phenyl, p-methylphenyl, naphthyl, etc.), or alkyl having from 1 to 12 carbon atoms, such as methyl, ethyl, isopropyl, n-pentyl, neopentyl, 2-chlorohexyl, etc., and preferably from 1 to 6 carbon atoms; and M is a solubilizing cation and preferably a monovalent cation such as an alkali metal or ammonium cation.

Exemplary dicarboxylic acids and functional equivalents of this type from which such ionic recurring units are derived are 3,3'-[(sodioimino)disulfonyl]dibenzoic acid;

3,3'-[(potassioimino)disulfonyl]dibenzoic acid, 3,3'-[(lithioimino)disulfonyl]dibenzoic acid;

4,4'-[(lithioimino)disulfonyl]dibenzoic acid;

4,4'-[(sodioimino)disulfonyl]dibenzoic acid;

4,4'-[(potassioimino)disulfonyl]dibenzoic acid; 3,4'-[(lithioimino)disulfonyl]dibenzoic acid;

3,4'-[(sodioimino)disulfonyl]dibenzoic acid;

5-[4-chloronaphth-1-ylsulfonyl(sodioimino)sulfonyl]isophthalic acid; 4,4'-[(potassioimino)disulfonyl]dinaphthoic acid;

5-[p-tolylsulfonyl(potassioimino)sulfonyl]isophthalic acid; 4-[p-tolylsulfonyl(sodioimino)sulfonyl]-1,5-naphthalenedicarboxylic acid;

5-[n-hexylsulfonyl(lithioimino)sulfonyl]isophthalic acid; 2-[phenylsulfonyl(potassioimino)sulfonyl]terephthalic acid and functional equivalents thereof. These and other dicarboxylic acids useful in forming preferred ionic recurring units are described in U.S. Pat. No. 3,546,180 (issued Dec. 8, 1970 to Caldwell et al) the disclosure of which is incorporated herein by reference.

A preferred monomeric unit of this type has the following structure:

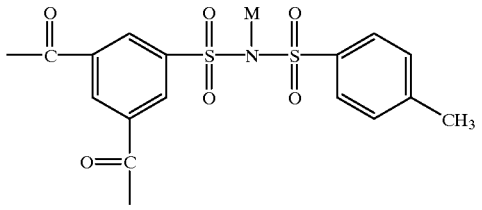

wherein M is as defined above.

It is also possible to have combinations of different ionic groups in the same recurring unit of a polyester ionomer, for example, as shown in U.S. Pat. No. 5,534,478 (the last structure in column 3).

A preferred class of subsantially amorphous polyester ionomers employed in the overcoat layer of the present invention comprises the polymeric reaction product of: a first dicarboxylic acid; a second dicarboxylic acid comprising an aromatic nucleus to which is attached sulphonic acid group; an aliphatic diol compound, and an aliphatic cycloaliphatic diol compound. The second dicarboxylic acid comprises from about 2 to 25 mol percent of the total moles of first and second dicarboxylic acids. The second diol comprises from about 0 to 50 mol percent of the total moles of the first and second diol. As the amount of the second dicarboxylic acid increases above 30 mol percent, the stain resistance of the processed photographic element tends to decrease. When the amount of the second dicarboxylic acid decreases below about 10 mol percent, silver retention in the final processed photographic element may tend to increase (unless, for example, the polymer is balanced with hydrophilic monomers such as diethylene glycol).

The first dicarboxylic acid or its anhydride, diester, or diacid halide functional equivalent may be represented by the formula: —CO—$R_1$—CO— where $R_1$ is a saturated or unsaturated divalent hydrocarbon, an aromatic or aliphatic group or contains both aromatic and aliphatic groups. Examples of such acids include isophthalic acid, 5-t-butylisophthalic acid, 1,1,3-trimethyl-3-4-(4-carboxylphenyl)-5-indancarboxylic acid, terephthalic acid, 2,6-naphthalenedicarboxylic acid, or mixtures thereof. The first acid may also be an aliphatic diacid where $R_1$ is a cyclohexyl unit or 2–12 repeat units of a methylene group, such as succinic acid, adipic acid, glutaric acid and others. Dicarboxylic acids which have moieties which are sensitive to actinic radiation are also useful. Exemplary radiation sensitive dicarboxylic acids or functional equivalents thereof are described in U.S. Pat. No. 3,929,489 (issued Dec. 30, 1975 to Arcesi et al) the disclosure of which is incorporated herein by reference. The first dicarboxylic acid is preferably an aromatic acid or a functional equivalent thereof, most preferably, isophthalic acid.

The second dicarboxylic acid may be a water-dispersible aromatic acid containing an ionic moiety that is a sulfonic acid group or its metal or ammonium salt as described earlier. Examples include the sodium, lithium, potassium or ammonium salts of sulfoterephthalic acid, sulfonaphthalenedicarboxylic acid, sulfophthalic acid, sulfoisophthalic acid, and 5-(4-sulfophenoxy) isophthalic acid, or their functionally equivalent anhydrides, diesters, or diacid halides. Most preferably, the second dicarboxylic acid comprises a soluble salt of 5-sulfoisophthalic acid or dimethyl 5-sulfoisophthalate. The ionic dicarboxylic acid repeating units of the polyester ionomers employed as protective overcoat layers in accordance with the invention comprise from about 1 to about 25 mol percent, preferably about 10 to 25 mole percent of the total moles of dicarboxylic acids.

The dicarboxylic acid recurring units are linked in a polyester by recurring units derived from difunctional compounds capable of condensing with a dicarboxylic acid or a functional equivalent thereof. Suitable diols are represented by the formula: HO—$R_2$—OH, where $R_2$ is aliphatic, cycloaliphatic, or aralkyl. Examples of useful diol compounds include the following: ethylene glycol, diethylene glycol, propylene glycol, 1,2-cyclohexanedimethanol, 1,2-propanediol, 4,4'-isopropylidene-bisphenoxydiethanol, 4,4'-indanylidene-bisphenoxydiethanol, 4,4'-fluorenylidene-bisphenoxydiethanol, 1,4-cyclohexanedimethanol, 2,2'-dimethyl-1,3-propanediol, p-xylylenediol, and glycols having the general structure $H(OCH_2CH_2)_n$—OH or $H(CH_2)_nOH$, where n=2 to 10. Diethyleneglycol, 1,4-cyclohexanedimethanol, pentanediol, and mixtures thereof are especially preferred.

The polyester ionomers of this invention have a glass transition temperature (Tg) of about 100° C. or less and, preferably, from about 25° C. to 70° C. Tg values can be determined by techniques such as differential scanning calorimetry or differential thermal analysis, as disclosed in N. F. Mott and E. A. Davis, *Electronic Processes in Non-Crystalline Material*, Oxford University Press, Belfast, 1971, at p. 192. Preferred polyester ionomers for use in the present invention include the EASTMAN AQ™ polymers manufactured by Eastman Chemical Company of Kingsport, Tenn.

The polymers of this invention are relatively high molecular weight (Mn preferably above 10,000, more preferably above about 14,000) substantially amorphous polyesters that disperse directly in water without the assistance of organic co-solvents, surfactants, or amines. As indicated above, this water dispersibility is attributable in large part to the presence of ionic substituents, for example, sulfonic acid moieties or salts thereof, for example, sodiosulfo moieties ($SO_3Na$) in the polymer. Properties and uses of these polymers are described in Publication No. GN-389B of Eastman Chemical Company, dated May 1990, the disclosure of which is incorporated herein by reference. Especially preferred are poly[1,4-cyclohexylenedimethylene-co-2,2'-oxydiethylene (46/54) isophthalate-co-5-sodiosulfo-1,3-benzenedicarboxylate (82/18)] (obtained as EASTMAN AQ™ 55 polymer, Tg 55° C. from Eastman Chemical Co.); poly[1,4-cyclohexylenedimethylene-co-2,2'-oxydiethylene (22/78) isophthalate-co-5-sodiosulfo-1,3-benzenedicarboxylate (89/11)] (obtained as EASTMAN AQ™ 38 polymer, Tg 38° C., from Eastman Chemical Co.), and the like.

The commercially available salt forms of the polyester ionomer, including the aforementioned AQ® polymers, have been shown to be effective in the present invention.

Mixtures of substantially amorphous polyester ionomers can be used if desired. Also, as indicated above, the polyester ionomer may comprise a blend with at least one other water-dispersible polymer. The other polymer may comprise a variety of materials, including condensation and/or addition polymer such as vinyl polymers, polyurethanes, urethane-vinyl hybrids such as IPNs, polyethylenes, and the like or mixtures thereof. Urethane-vinyl hybrids are described in commonly assigned U.S. Ser. No. 09/353,939 and U.S. Ser. No. 09/235,437, hereby incorporated by reference in their entirety. Examples of such water-dispersible polymers also include, for example, polyvinyl chloride and the like in U.S. Pat. No. 5,853,926 to Bohan et al.

Other optional non-soluble vinyl polymers for use in overcoat compositions according to the present invention include, for example, those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

In accordance with this invention, the protective overcoat preferably comprises, in addition to the polyester polymer described above, a selected water-soluble polymer. In a preferred embodiment the polymer is polyvinyl alcohol, which polymer has been found to yield coatings that are relatively uniform and to enhance the diffusion rate of the developer into the underlying emulsions.

The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processability. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of polyurethane-containing component. In one preferred embodiment of the invention, the polyvinyl alcohol is present in the overcoat in the amount between 1 and 60 weight percent of the polyester-containing copolymer, preferably between 5 and 50 weight percent of the polyester copolymer, most preferably between 10 and 45 weight percent of the polyester-containing copolymer.

Optionally, other water-soluble polymers, for use in combination with the polyester inonomer, in addition to or in place of the polyvinyl alcohol, may suitably be present in amounts up to about 50 weight percent by weight of the polyester ionomer. Examples of such water-soluble polymers that may be added include cellulose ethers and their derivatives, n-vinyl amides, functionalized polyesters, poly (ethylene oxide), dextrans, starch, proteins including gelatin, whey and albumin, poly(acrylic acid) and its homologs, poly(ethyl oxazolines), alginates, gums, and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958).

Optionally, the coating composition in accordance with the invention may also contain suitable crosslinking agents for crosslinking the polyester-containing component. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of polyester-containing component and any additional polymers.

The polymer overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol® OT), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published Dec. 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the polyester ionomer may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004, 927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No. 308119, published Dec. 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published Dec. 1989, pages 1007 to 1008. Preferably, a commercial embodiment involve simultaneous co-extrusion.

The laydown of the overcoat will depend on its field of application. For a photographic element, the laydown of the polyurethane-containing copolymer is suitably at least 0.54 $g/m^2$ (50 $mg/ft^2$), preferably 1.08 to 5.38 $g/m^2$ (100 to 500 $mg/ft^2$), most preferably 1.61 to 3.23 $g/m^2$(150 to 300 $mg/ft^2$). It may be advantageous to increase the amount of polyvinyl alcohol in the overcoat as the laydown increases in order to improve the developability.

After applying the coating composition to the support, it may be dried over a suitable period of time, for example 2 to 4 minutes. In the event of cracking, especially at lower levels of polyvinyl alcohol or when using an alternative film-forming polymer, it may be advantageous to adjust the temperature and/or humidity of the drying step to eliminate or reduce this cracking problem. Without wishing to be bound by theory, it is believed that higher levels of polyvinyl alcohol with limited degree of hydrolysis reduces the tendency of the polyvinyl alcohol to block the release of water during drying, which might otherwise occur with overly fast film formation and drying. Thus, polyvinyl alcohol according to one embodiment of the invention, by delaying film formation allows the release of water during drying which if blocked might otherwise adversely affect the uniformity of the overcoat.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December., 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such as negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of a hydrophilic polymer, according to one embodiment of the present invention, facilitates this method. It has been found the the hydrophilic polymer can provide improved wettability of the surface during processing and, at the same time, allows more of the polymer to be washed out during the processing, so that the final product is more water resistant. Suitably at least 30%, preferably greater than 50%, more preferably greater than 75% of the original amount of one or more hydrophilic polymers in the overcoat is washed away from the overcoat layer during processing of the exposed photographic element, such that the final product is depleted in hydrophilic polymer in the overcoat and hence relatively more water resistant. Although the processing-solution-permeable overcoat does not require fusing, optional fusing may improve the water resistance further.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping. The polymer overcoat may be further coalesced by fusing (heat and/or pressure) if needed after processing without substantial change or addition of chemicals in the processing step to form a fully water impermeable protective overcoat with excellent gloss characteristics. Optional fusing may be carried out at a temperature of from 25 to 175° C., or lower for pressure fusing.

The present invention is illustrated by the following examples.

EXAMPLES

Polyester ionomers used in the following examples, which polyesters are referred to as PE1 to PE8, are listed in Table 1 below along with their composition and glass transition temperature. PE1 and PE4 were synthesized according to the procedure described in U.S. Pat. No. 5,939,335. PE2 and PE3 were synthesized according to the preparation outlined below. The other ionomers listed in Table 1 include Eastman AQ® polyesters AQ55 (PE5) and AQ38 (PE7) which were purchased from Eastman Chemical Company, and Eastman ES-100® (PE8) purchased from ABCO Industries, Inc. The ionomer PE6 is PE5 ion exchanged to the free acid.

Synthesis of PE2:

In a 250-niL long-necked flask, 52.4 g (0.270 mol) of dimethyl isophthalate, 8.9 g (0.030mol) of dimethyl 5-sulfoisophthalate, sodium salt, 18.6 g (0.129 mol) of 1,4-cyclohexanedimethanol (mixture of cis and trans isomers), 25.41 g (0.239mol) of diethylene glycol, 0.25 g of sodium acetate, and 0.05 g of Irganox 1010 were combined and the flask flushed with nitrogen gas. Titanium(IV) isopropoxide (2 drops) was then added to the flask. The flask was fitted with a sidearm adapter and a nitrogen inlet tube that extended to the bottom of the flask, and was then immersed in a salt bath at 200° C. Heating was continued for 3.75 hr over which time the temperature was increased to 240° C. while the theoretical volume of methanol was collected. Then the nitrogen inlet tube was replaced with a mechanical stirrer, and the pressure was reduced over 2 hr to 0.07 torr. Heating at 240° C. at 0.07 torr was continued for an additional 3 hr. The melt was clear amber and became very viscous. The flask was allowed to cool under vacuum, returned to atmospheric pressure under nitrogen. The polymer was isolated by cooling in liquid nitrogen and breaking the flask.

Synthesis of PE3:

PE3 was synthesized using essentially the same procedure as for PE2 except that dimethyl 5-sulfoisophthalate, sodium salt was increased to 16.0 g (0.054moles) and dimethyl isophthalate was reduced to 47.77 g (0.246moles).

The polyvinyl alcohols (PVA) used in the following examples were as follows: V1 (Airvol® 203), obtained from Air Products which was 87 to 89% hydrolyzed (by hydrolyzed is meant that the acetate groups in the monomeric units are converted to hydroxy groups); V2, 88% hydrolyzed purchased from Acros Organics (N.J.). The crosslinker used with the polyester ionomer formulation was either CX 100® (a polyfunctional aziridine), obtained from Neo Resins (a division of Avecia) or Bayhydur ®XP7063, a water-dispersible polyisocyanate obtained from Bayer. The paraffin/camauba lubricants, ML155, ML180, ML182, used in the coatings were purchased from Michelman Inc. For comparison, a urethane-vinyl polymer C1 was synthesized as follows.

Synthesis of Polymer C1

Into a dry reactor was charged 96 grams of a diol (Millester® 9-55, MW2000 from Polyurethane Corporation of America), 87 grams of the methylene bis(4-cyclohexyl) isocyanate (Desmodur®W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point 24 grams of methyl methacrylate were added and stirred for 1 hour at the same temperature. The resultant prepolymer was cooled to below 40° C., dissolved in a vinyl monomer mixture consisting of 113 grams of n-butyl acrylate, and 188 grams of methyl methacrylate, and then treated with 1 grams of triethylamine and 2.5 grams of initator (AIBN). To this mixture was added 1000 ml deoxygenated water followed by 10 grams of ethylene diamine in 20 grams of water. The dispersion was heated to 65° C., held there with stirring for 2 hours and heated further to 80° C. for 10 hours. The resulting dispersion of the urethane acrylic copolymer was used as polymer C1 having an acid number of 11.

TABLE 1

| Polyester ionomer | Composition | Tg (° C.) |
|---|---|---|
| PE1 | 8 mole % sodium sulfophthalic acid<br>42 mole % 1,4-cyclohexanedicarboxylic acid<br>16 mole % octane diol<br>34 mole % 1,4-cyclohexanedimethanol | 32 |
| PE2 | 5 mole % sodium sulfophthalic acid<br>45 mole % isophthalic acid<br>29 mole % diethylene glycol<br>21 mole % 1,4-cyclohexanedimethanol | 40 |
| PE3 | 9 mole % sodium sulfophthalic acid<br>41 mole % isophthalic acid<br>29 mole % diethylene glycol<br>21 mole % 1,4-cyclohexanedimethanol | 41 |
| PE4 | 8 mole % sodium sulfophthalic acid<br>42 mole % 1,4-cyclohexanedicarboxylic acid<br>6 mole % octane diol<br>44 mole % 1,4-cyclohexanedimethanol | 44 |
| PE5 | Eastman AQ 55 ™ S polymer | 55 |
| PE6 | PE5 ionexchanged to the free acid | |
| PE7 | AQ 38 ™ S polymer | 38 |
| PE8 | ES-100 ™ S polymer | 45–50 |

All the protective overcoats were coated over paper that was previously coated with light sensitive emulsions according to the formulation described below in Tables 2 and 3. In all instances, the coatings were made directly over layer 6. The check coating, however, included Layer 7. The gelatin-containing layers were hardened with bis(vinylsulfonyl methyl) ether at 1.95% of the total gelatin weight.

TABLE 2

| | | Laydown ($g/m^2$) |
|---|---|---|
| Layer 7 | Overcoat | |
| | Gelatin | 0.6456 |
| | Ludox AM ™ (colloidal silica) | 0.1614 |
| | Polydimethylsiloxane (DC200 ™ ) | 0.0202 |
| | 5-chloro-2-methyl-4-isothiazolin-3-one/2-methyl-4-isothiazolin-3-one (3/1) | 0.0001 |
| | SF-2 | 0.0032 |
| | Tergitol 15-S-5 ™ (surfactant) | 0.0020 |
| | SF-1 | 0.0081 |
| | Aerosol OT ™ (surfactant) | 0.0029 |
| Layer 6 | UV Layer | |
| | Gelatin | 0.8231 |
| | UV-1 | 0.0355 |
| | UV-2 | 0.2034 |
| | ST-4 | 0.0655 |
| | SF-1 | 0.0125 |
| | S-6 | 0.0797 |
| | 5-chloro-2-methyl-4-isothiazolin-3-one/2-methyl-4-isothiazolin-3-one (3/1) | 0.0001 |
| Layer 5 | Red Sensitive Layer | |
| | Gelatin | 1.3558 |
| | Red Sensitive silver (Red EM-1) | 0.1883 |
| | IC-35 | 0.2324 |
| | IC-36 | 0.0258 |
| | UV-2 | 0.3551 |
| | Dibutyl sebacate | 0.4358 |
| | S-6 | 0.1453 |
| | Dye-3 | 0.0229 |
| | Potassium p-toluenethiosulfonate | 0.0026 |
| | 5-chloro-2-methyl-4-isothiazolin-3-one/2-methyl-4-isothiazolin-3-one (3/1) | 0.0001 |
| | Sodium Phenylmercaptotetrazole | 0.0005 |
| | SF-1 | 0.0524 |

TABLE 2-continued

| | | Laydown ($g/m^2$) |
|---|---|---|
| Layer 4 | M/C Interlayer | |
| | Gelatin | 0.7532 |
| | ST-4 | 0.1076 |
| | S-3 | 0.1969 |
| | Acrylamide/t-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one (3/1) | 0.0001 |
| Layer 3 | Green Sensitive Layer | |
| | Gelatin | 1.1944 |
| | Green Sensitive silver (Green EM-1) | 0.1011 |
| | M-4 | 0.2077 |
| | Oleyl Alcohol | 0.2174 |
| | S-3 | 0.1119 |
| | ST-21 | 0.0398 |
| | ST-22 | 0.2841 |
| | Dye-2 | 0.0073 |
| | 5-chloro-2-methyl-4-isothiazolin-3-one/2-methyl-4-isothiazolin-3-one (3/1) | 0.0001 |
| | SF-1 | 0.0236 |
| | Potassium chioride | 0.0204 |
| | Sodium Phenylmercaptotetrazole | 0.0007 |
| Layer 2 | Interlayer | |
| | Gelatin | 0.7532 |
| | ST-4 | 0.1076 |
| | S-3 | 0.1969 |
| | 5-chloro-2-methyl-4-isothiazolin-3-one/2-methyl-4-isothiazolin-3-one (3/1) | 0.0001 |
| | Catechol disulfonate | 0.0323 |
| | SF-1 | 0.0081 |
| Layer 1 | Blue Sensitive Layer | |
| | Gelatin | 1.3127 |
| | Blue sensitive silver (Blue EM-1) | 0.2399 |
| | Y-4 | 0.4143 |
| | ST-23 | 0.4842 |
| | Tributyl Citrate | 0.2179 |
| | ST-24 | 0.1211 |
| | ST-16 | 0.0095 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one (3/1) | 0.0002 |
| | SF-1 | 0.0366 |
| | Potassium chloride | 0.0204 |
| | Dye-1 | 0.0148 |
| Photographic paper support | | |

TABLE 3
IC-35
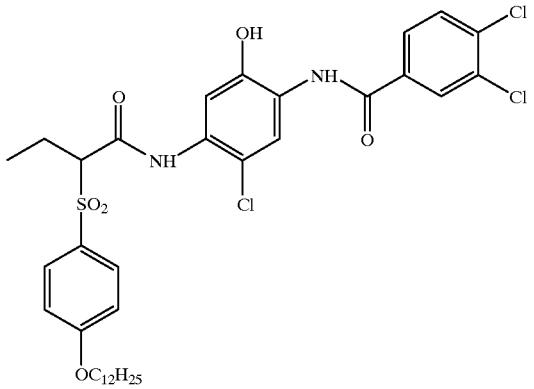
IC-36
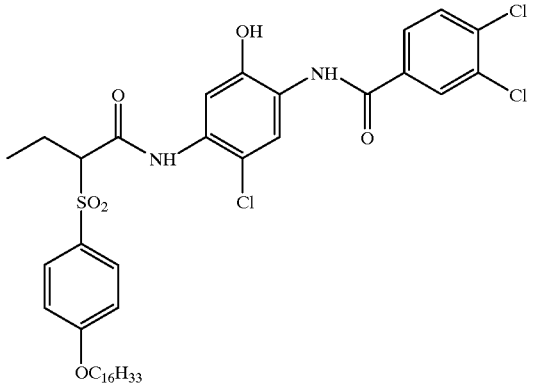
M-4
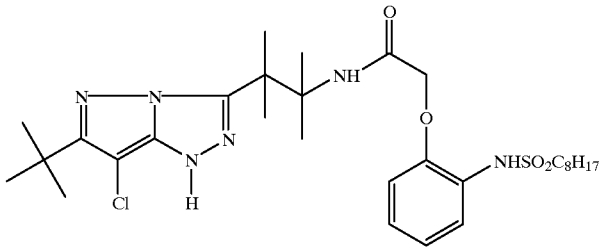
Y-4
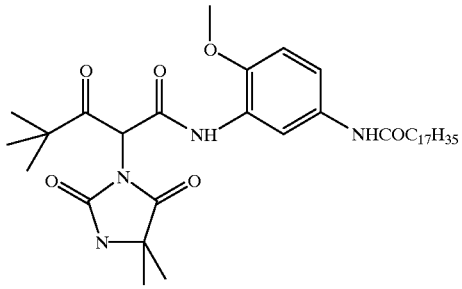

TABLE 3-continued
Dye-1
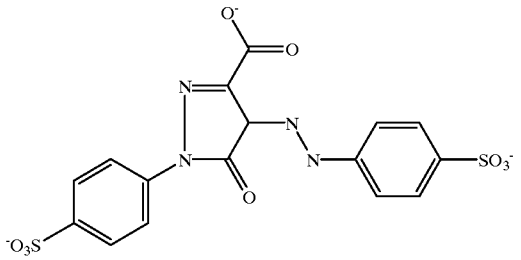
Dye-2
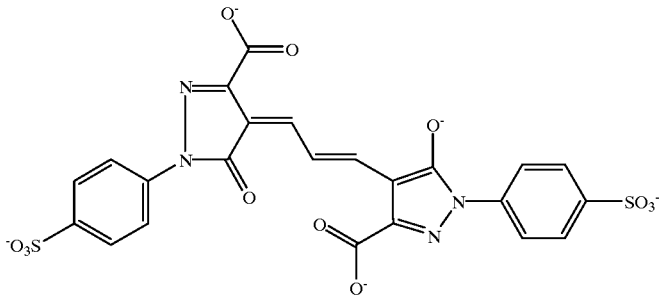
Dye-3
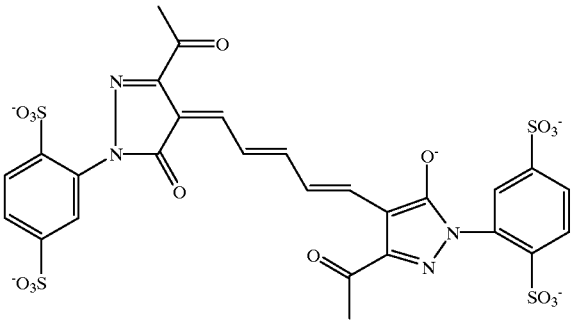
S-3 Diundecyl phthalate
S-6 Tris(2-ethylhexyl)phosphate
ST-4
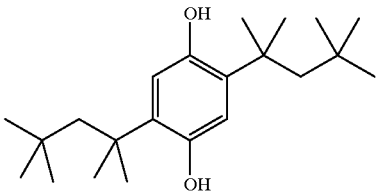
ST-16
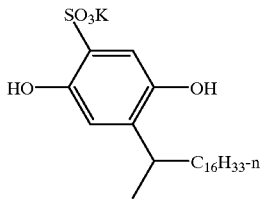
ST-21
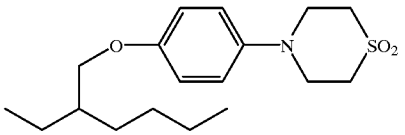

TABLE 3-continued

ST-22

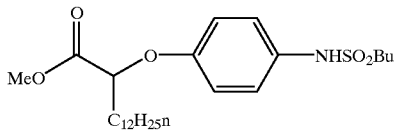

ST-23

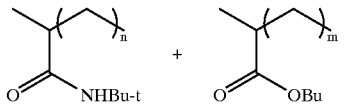

ST-24

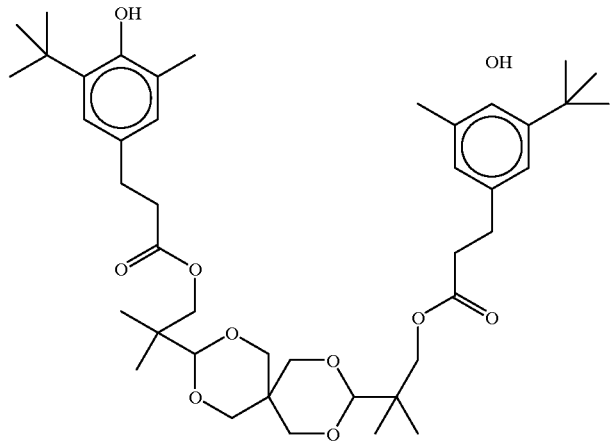

SF-1

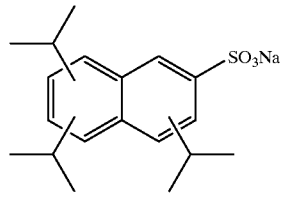

SF-2 $CF_3.(CF_2)_7.SO_3Na$

UV-1

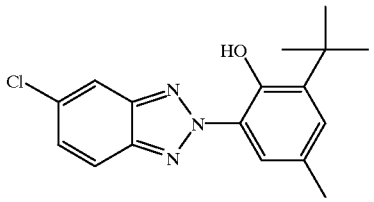

UV-2

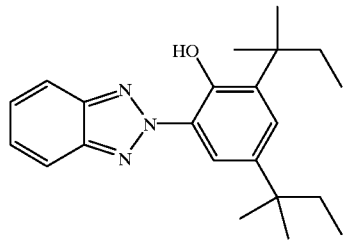

Test for Dye-density Development by RA4 Process

The samples were exposed to 1/10 seconds of daylight of color temperature 3000K, through a 0–3 density step chart in combination with a heat-5 absorbing filter. After exposure, samples were processed (45 seconds) with the Kodak RA4 process to generate density. The assessment of developability was done by comparing the Dmax of each color record obtained from the DlogE curves to the check coating. The percent developability of each color record was calculated by assigning a value of 100 percent to the check paper. Lower percentages are indicative of slower developability.

Test for Stain Resistance

Samples, without being exposed to light, were processed through the Kodak RA4 process to obtain white Dmin samples. The stain resistance was evaluated by placing the staining media on the sample for 10 minutes followed by a 30-second water rinse to remove the staining agent from the surface. Each sample was then air dried, visually examined for residual stain and compared to the unprotected check coating. No observable stain was considered excellent vs. a rating of poor for the easily stained check. Any position in between were rated very good, good and fair based on the relative extent of stain. The staining agents were: Minute Maid® punch and an aqueous solution of Ponceau S red dye prepared by dissolving 1 gram of dye in 1000 g mixture of acetic acid and water (5:95).

Wet (Swollen) Durability Quantification Test

To test the durability of these feature coatings in the wet/swollen state, 1 inch×3 inch samples were cut and fixed to commercial glass microscope slides. The 1 inch×1 inch center section was then contacted with an excess amount of distilled water and allowed to stand for 2 minutes. After this 2 minute soak period, the excess water was blotted off and the sample was immediately placed in a modified pin-on-disk wear test device possessing a reciprocating stage attachement. A metal cylinder wrapped with an absorbant cloth wiping agent was used as the static friction partner. A 0.25 cm/second stroke speed and a 5 N normal force was used in all cases. Frictional force data were collected during the course of each run and analyzed to calculate an average lateral force value from which the "wet" coefficient of friction (COF) was calculated. The lower the COF the greater the wet durability of the coating to wiping with a media such as a paper towel.

Optical profilometry was also used to quantify the extent of the resulting surface damage. For each coating, twenty random spots were selected and imaged using a WYKO optical profilometer. The mean peak roughness (Rpm) and mean valley roughness (Rvm) were determined from the profilometry data. The greater the roughness the more the damage.

Test for Wet Abrasion:

Samples, exposed to light, were processed through the Kodak RA4 process to obtain Dmax samples. The wet abrasion resistance was evaluated by placing a large drop of water on the sample for 10 minutes followed by wiping the area with a Scott 2-ply paper towel to remove the excess water from the surface. The extent of wet abrasion was visually examined and qualitatively rated with excellent being no observable scratches and poor being highly visible scuffing of the overcoat.

Test for Fingerprint Resistance:

Fingerprints were placed on Dmax samples and left for 72 hours. They were then wiped off using a tissue and examined for visible fingerprints. Samples that were rated excellent were the ones that had no visible fingerprints or residual smear. In those rated poor the fingerprints were still visible.

Examples 1–6

Examples 1–6 show the effect of various overcoats according to the present invention on percent developability, resistance to punch stain and wet abrasion. The various polyester ionomers were coated over layer 6 of the sensitized paper support described earlier to obtain a nominal coverage of 1.88 g/m$^2$. All coatings had 35 weight % PVA of the respective polymer. The percent by weight CX100® crosslinker with respect to the polymer is shown in Table 4. For comparison, a check paper as described previously, without the polymer overcoat (Check 1) and the urethane-vinyl copolymer (C1, Check 2, also coated over layer 6)were used. The results of the tests are shown in Table 4 below.

TABLE 4

| Examples | Polymer | PVA | % Cross-linker | Percent developability | | | Resistance to Punch | Resistance to Wet Abrasion |
|---|---|---|---|---|---|---|---|---|
| Check 1 | None | None | 0 | 100 | 100 | 100 | Poor | No scuff Water mark |
| Check 2 | C1 | V1 | 1 | 100 | 97 | 94 | Excellent | Not good |
| 1 | PE5 | V2 | 1 | 100 | 98 | 98 | Excellent | Excellent |
| 2 | PE5 | V2 | 0 | 102 | 101 | 99 | Excellent | Excellent |
| 3 | PE8 | V1 | 1 | 101 | 100 | 99 | Excellent | Excellent |
| 4 | PE5/C1 50/50 | V1 | 0.5 | 98 | 95 | 91 | Excellent | Good |
| 5 | PE5/C1 75/25 | V1 | 0.5 | 98 | 95 | 92 | Excellent | Excellent |
| 6 | PE1 | V1 | 1 | 102 | 101 | 99 | Excellent | Very good |

As shown in Table 4 above, the polyester ionomers of Examples 1–3 and 6 show excellent or very good wet abrasion and punch-stain resistance compared to the Check 1 and better wet-abrasion resistance than the paper overcoated with the urethane-vinyl copolymer C1. Check 2 and Examples 4 and 5 (which are mixtures of C1 with PE5) show improved performance as the level of PE5 in the polymer is increased. The polyester ionomers PE5 and PE 1 also showed excellent sensitometric performance in terms of percent developability.

Examples 7–10

The polyester ionomer PE5 in combination with various lubricants were coated over layer 6 of the sensitized paper support described earlier to a nominal coverage of 1.83 g/m$^2$ of polymer and 0.05 g/m$^2$ of lubricant to show the effect of the various lubricants on improving the coefficient of friction. All coatings had 35 weight % V1 and 1 weight % CX100 of the polymer. For comparison, the ionomer PE5 was coated without the lube to a nominal coverage of 1.88 g/m$^2$.

TABLE 5

| Example | LUBE | COF | Resistance to Wet abrasion |
|---|---|---|---|
| 7 | No | 0.51 | Excellent |
| 8 | ML 182 | 0.28 | Very Good |
| 9 | ML 180 | 0.31 | Very good |
| 10 | ML 155 | 0.30 | Excellent |

Table 5 shows that the inclusion of lubricant reduces the coefficient of friction while maintaining the resistance to wet-abrasion. The percent developability was also excellent.

Examples 11–14

Examples 11–14 show the effect of polymer dry coverage on wet-abrasion resistance. The polyester ionomer PE5 was coated over layer 6 of the sensitized paper support described earlier to nominal coverages as described in Table 6 below. The percent PVA, V1, levels with respect to the polymer are also shown in Table 6.

TABLE 6

| Sample | Coverage of Polymer $g/m^2$ | PVA Level | Resistance to Wet Abrasion |
|---|---|---|---|
| 11 | 1.08 | 20 | Good |
| 12 | 1.35 | 20 | Very good |
| 13 | 1.08 | 35 | Very good |
| 14 | 1.35 | 35 | Very good |

As Table 6 shows even at coverages as low as $1.08 g/m^2$, the resistance to wet abrasion is not compromised.

Examples 15–20

Examples 15–20 illustrate the use of other water soluble polymers that can be used in place of PVA in compositions according to the present invention. These other water soluble polymers included Dextran (DX) which was obtain from Polysciences Inc. and had a molecular weight of 15–20K, poly(ethyloxazoline) (POx) which was purchased from Aldrich Chemical Company, Inc. and had a molecular weight of 50K, and Lukvisol K30® poly(vinyl pyrrolidone) (PVP) which was obtained from GAF and had a molecular weight of 40K. The polyester ionomer PE5, in combination with various water solubel polymers, was coated over layer 6 of the sensitized paper support described earlier to a nominal coverage of 1.88 $g/m^2$ of polymer. The weight percent of these polymers with respect to PE5 is listed in Table 7.

TABLE 7

| Sample | Water Soluble Polymer | % Water Sol. Polymer | Resistance to Wet Abrasion |
|---|---|---|---|
| 15 | DX | 35 | Excellent |
| 16 | POx | 35 | Excellent |
| 17 | PVP | 35 | Excellent |
| 18 | DX | 25 | Excellent |
| 19 | POx | 25 | Excellent |
| 20 | PVP | 25 | Good |

Many other water soluble polymers can be used in place of poly(vinyl alcohol) to yield processed coatings that exhibit good resistance to wet abrasion/

Examples 21–30

The finger print resistances for the various formulations listed in Table 8 below were examined. All polymers were coated over layer 6 of the sensitized paper support described earlier to a nominal coverage of 1.88 $g/m^2$ of polymer along with 35 weight % PVA with respect to the polymer. The type of PVA and the percent of CX100 crosslinker with respect to the polymer are also listed in Table 8.

TABLE 8

| Example | Polymer | PVA | CX100 level | Fingerprint resistance |
|---|---|---|---|---|
| Check 1 | None | None | 0 | Poor |
| 21 | PE5 | V2 | 1 | Excellent |
| 22 | PE5 | V2 | 0.5 | Excellent |
| 23 | PE5 | V2 | 0.25 | Excellent |
| 24 | PE5 | V1 | 1 | Excellent |
| 25 | PE5 | V1 | 0 | Excellent |
| 26 | PE5/Cl 50/50 | V2 | 1 | Excellent |
| 27 | PE5/Cl 25/75 | V2 | 1 | Excellent |
| 28 | PE5/Cl 75/25 | V2 | 1 | Excellent |
| 29 | PE8 | V1 | 1 | Excellent |
| 30 | PE1 | V1 | 1 | Excellent |

As the Table shows, finger prints were easily removed from the polyester ionomer containing processed coatings compared to the check regardless of the crosslinker level or type of PVA and blends with other polymers.

Examples 31–34

Examples 31–34 show further polyester ionomers for providing stain-resistance in a photographic paper according to the present invention. The various polyester ionomers as shown in Table 9 were coated over layer 6 of the sensitized paper support described earlier to obtain a nominal coverage of 1.88 $g/m^2$. The level of sulfonated monomer is listed as a mole percentage of the total polyester ionomer. All coatings had 35 weight % V1 and 1 weight % CX100® crossliner, based on the weight of the respective polymer. The coated papers were tested for stain resistance with Ponceau S red dye. The results of the tests are shown in Table 9 below.

TABLE 9

| Example | Polymer | Mole % Sulfonated Monomer | Resistance to Ponceau S Red Dye |
|---|---|---|---|
| 31 | PE6 | 5 | No stain |
| 32 | PE2 | 5 | No stain |
| 33 | PE3 | 9 | No stain |
| 34 | PE4 | 8 | No stain |

Examples 35–36

Examples 35 and 36 show results from the wet durability quantification tests where the polyester ionomer coatings are compared to a standard check paper and a wet-abrasion prone overcoat derived from C1. The various polymers listed in Table 10 below were coated over layer 6 of the sensitized paper support described earlier to obtain a nominal coverage of 1.88 $g/m^2$. The overcoat of Example 35 was crosslinked with 3 weight percent Bayhydur® XP7063 and the overcoat of Example 36 was crosslinked with with 1% CX100® crosslinker, with respect to the weight of the polymer. The results of the wet durability quantification tests are shown in Table 10 below.

TABLE 10

| Example | Polymer | Wet COF | Rpm | Rvm |
|---|---|---|---|---|
| Check 1 | None | 0.6 | 1.1 | 0.7 |
| Check 2 | Cl | 0.8 | 8.3 | 5.1 |
| 35 | PE5 | 0.4 | 2.5 | 0.8 |
| 36 | PE5 | 0.3 | 1.7 | 0.7 |

Table 10 shows that the wet COF is lower for samples overcoated with the polyester ionomer as compared to the check coatings indicating that the surface is less tacky in the wet state and therefore has greater durability towards wiping with a rough media such as a paper towel. Further, the lower mean peak (Rpm) and valley roughness numbers (Rvm) obtained from profilometry for 35 and 36 compared to Check 2 show that the extent of physical damage to the surface is much lower in the case of the polyester ionomer overcoat compared to the urethane-acrylic overcoat.

The invention has been described in detail with particular reference to certain preferred embodiments thereof, but it will be understood that variations and modifications can be effected within the spirit and scope of the invention.

What is claimed is:

1. A photographic imaging element comprising:

a support;

at least one light sensitive silver halide emulsion layer superposed on the support; and an overcoat layer overlying the at least one light sensitive silver halide emulsion layer, which overcoat comprises a polyester ionomer and a water-soluble polymer selected from the group consisting of a polyvinyl alcohol, n-vinyl amide, poly(ethylene oxide), and poly (ethyl oxazoline), wherein at least 30 weight percent of the water-soluble polymer is capable of being washed out during RA4 photographic processing.

2. The photographic element of claim 1 wherein the polyester ionomer comprises ionic or ionizable groups selected from the group consisting of sulfonic acid, sulfonimide, and compatible combinations thereof.

3. The photographic element of claim 1 wherein the overcoat further comprises UV absorbers, surfactants, emulsifiers, coating aids, lubricants, matte particles, rheology modifiers, crosslinking agents, antifoggants, inorganic fillers, pigments, magnetic particles and/or biocides.

4. The photographic imaging element of claim 1 wherein the overcoat has a laydown of at least 0.54 $g/m^2$ (50 $mg/ft^2$).

5. The photographic imaging element of claim 1 wherein the water-soluble polymer is polyvinyl alcohol.

6. The photographic imaging element of claim 1 wherein the polyester ionomer comprises monomeric units derived from monomers selected from the group consisting of 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, equivalent salt forms of the foregoing compounds, and combinations thereof.

7. The photographic imaging element of claim 1 wherein the polyester ionomer comprises monomeric units derived from a polyol selected from the group consisting of ethylene glycol, diethylene glycol, triethylene glycol, 1,3-propanediol, 1,4-butanediol, 2-methyl-1,5-pentanediol, neopentyl glycol, 1,4-cyclohexanedimethanol, 1,4-bis(β-hydroxyethoxy)cyclohexane, quinitol, norcamphanediols, 2,2,4,4-tetraalkylcyclobutane-1,3-diols, p-xylene diol, bisphenol A, and combinations thereof.

8. The photographic imaging element of claim 1 wherein the polyester ionomer comprises the polymeric reaction product of: a first dicarboxylic acid; a second dicarboxylic acid comprising an aromatic nucleus to which is attached sulphonic acid group; an aliphatic diol compound, and an aliphatic cycloaliphatic diol compound.

9. The photographic imaging element of claim 8 wherein the second dicarboxylic acid comprises from about 2 to 25 mol percent of the total moles of first and second dicarboxylic acids and the second diol comprises from about 0 to 50 mol percent of the total moles of the first and second diol.

10. The photographic imaging element of claim 1 wherein the water-soluble polymer comprises polyvinyl alcohol having a MW of less than or equal to about 100,000, with the proviso that if said molecular weight is greater than about 70,000, then the degree of hydrolysis is less than 95%.

11. The photographic imaging element of claim 1 wherein the polyester ionomer is blended with a interpenetrating or semi-interpenetrating polymer network comprising at least two polymers.

12. The photographic element of claim 1 wherein the support comprises polymeric films, papers or glass.

13. The photographic element of claim 1 wherein the support is reflective.

14. The photographic element of claim 1 wherein the support comprises paper base and a layer of biaxially oriented polyolefin sheet between a first side of said paper base and said silver-halide emulsion layer.

15. A method of making a photographic print comprising:

(a) providing a photographic element comprising a support, a silver-halide emulsion layer superposed on a side of said support, a processing-solution-permeable overcoat overlying the silver-halide emulsion layer, said protective overcoat comprising a polyester ionomer having ionic or ionizable functionalities, said overcoat further comprising a water-soluble or solubilizable hydrophilic polymer wherein at least 30 weight percent of the water-soluble polymer is washed out during photographic processing;

(b) imagewise exposing the photographic element to light;

(c) developing the photographic element in a developer solution having a pH greater than 7 to obtain the photographic print; and (d) optionally fusing the processing solution permeable overcoat.

16. The method of claim 15 wherein the overcoat further comprises a polymer selected from the group consisting of polyvinyl alcohol, cellulose ethers, n-vinyl amides, polyesters, poly(ethylene oxide), starch, proteins, whey, albumin, poly(acrylic acid), alginates, gums, and combinations thereof.

17. The method of claim 16 wherein the fusing step further comprises texturing a surface of the processing solution permeable overcoat.

* * * * *